US009917367B2

(12) United States Patent
Yosui et al.

(10) Patent No.: US 9,917,367 B2
(45) Date of Patent: Mar. 13, 2018

(54) ANTENNA DEVICE AND COMMUNICATION APPARATUS

(71) Applicant: Murata Manufacturing Co., Ltd., Nagaokakyo-shi, Kyoto-fu (JP)

(72) Inventors: Kuniaki Yosui, Nagaokakyo (JP); Hirokazu Yazaki, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 94 days.

(21) Appl. No.: 14/994,557

(22) Filed: Jan. 13, 2016

(65) Prior Publication Data

US 2016/0126631 A1 May 5, 2016

Related U.S. Application Data

(63) Continuation of application No. PCT/JP2014/068549, filed on Jul. 11, 2014.

(30) Foreign Application Priority Data

Jul. 16, 2013 (JP) ..... 2013-147457

(51) Int. Cl.
*H01Q 21/08* (2006.01)
*H01Q 7/06* (2006.01)
(Continued)

(52) U.S. Cl.
CPC ..... *H01Q 7/06* (2013.01); *H01Q 1/2208* (2013.01); *H01Q 1/523* (2013.01); *H01Q 21/08* (2013.01)

(58) Field of Classification Search
CPC ..... H01Q 1/2208; H01Q 7/06; H01Q 21/08; H01Q 1/523
See application file for complete search history.

(56) References Cited

U.S. PATENT DOCUMENTS

2013/0229319 A1 9/2013 Miura et al.

FOREIGN PATENT DOCUMENTS

JP 2001-185939 A 7/2001
JP 2004-253858 A 9/2004
(Continued)

OTHER PUBLICATIONS

Official Communication issued in International Patent Application No. PCT/JP2014/068549, dated Oct. 7, 2014.
(Continued)

*Primary Examiner* — Graham Smith
*Assistant Examiner* — Noel Maldonado
(74) *Attorney, Agent, or Firm* — Keating & Bennett, LLP

(57) ABSTRACT

An antenna device includes a power supply coil including wire patterns provided on or in magnetic layers and antenna coils including wire patterns provided on or in the magnetic layers. The power supply coil and the antenna coils include coil winding axes thereof coinciding with a lamination direction of the magnetic layers and generate magnetic field coupling to each other. The power supply coil is located on an inner side portion relative to the antenna coils when seen in the lamination direction. At least portions of the antenna coils are located on outer side portions relative to the power supply coil in the lamination direction. With this, an antenna device and a communication apparatus capable of communicating with a communication party reliably without forming an unnecessary communication path with a party-side coil are provided.

20 Claims, 11 Drawing Sheets

(51) Int. Cl.
*H01Q 1/52* (2006.01)
*H01Q 1/22* (2006.01)

(56) References Cited

FOREIGN PATENT DOCUMENTS

| | | | |
|---|---|---|---|
| JP | 2009-021970 | A | 1/2009 |
| JP | 2013-55684 | A | 3/2013 |
| JP | 2013-138404 | A | 7/2013 |

OTHER PUBLICATIONS

Official Communication issued in corresponding Japanese Patent Application No. 2015-228362 , dated Oct. 4, 2016.

ANTENNA DEVICE AND COMMUNICATION APPARATUS

BACKGROUND OF THE INVENTION

1. Field of the Invention

The present invention relates to an antenna device including an antenna coil on a magnetic layer and a communication apparatus including the antenna device.

2. Description of the Related Art

Near field communication (NFC), an example of communication standards that are implemented in an electronic apparatus such as a cellular phone, is a wireless communication technology that allows a reader/writer device and the electronic apparatus to communicate with each other by bringing the electronic apparatus in proximity to the reader/writer device and causing their coils to generate magnetic field coupling to each other. In recent years, an increase in a communication speed by the NFC or the like is required, and a band of an NFC antenna is therefore required to be broadened. Japanese Unexamined Patent Application Publication No. 2001-185939 discloses an antenna coil having a resonance coil that generates magnetic field coupling to a power supply coil and loading a resistance for adjusting a Q-value on the resonance coil so as to try to broaden a band thereof.

However, when the antenna coil disclosed in Japanese Unexamined Patent Application Publication No. 2001-185939 and a device of a communication party are brought close to each other, a coil in the device of the communication party (hereinafter, referred to as party-side coil) generates magnetic field coupling to not only the resonance coil of the antenna coil but also the power supply coil in some cases. In this case, two communication paths including a communication path of the power supply coil→the resonance coil→the party-side coil and a communication path of the power supply coil→the party-side coil are formed. When signals passing through the two communication paths have reverse phases, there arises a problem that the signals are cancelled out by each other and the party-side coil cannot receive the signals. This problem occurs in the same manner even when a transmission and reception relation between the antenna coil and the party-side coil is reversed.

SUMMARY OF THE INVENTION

In consideration of the above-mentioned circumstances, preferred embodiments of the present invention provide an antenna device and a communication apparatus capable of communicating with a communication party reliably without forming an unnecessary communication path with a party-side coil.

An antenna device according to an aspect of various preferred embodiments of the present invention includes magnetic layers, a power supply coil provided on or in the magnetic layers with a winding axis coinciding with a lamination direction of the magnetic layers, and a first antenna coil and a second antenna coil that are provided on or in the magnetic layers with winding axes coinciding with the lamination direction of the magnetic layers and that generate magnetic field coupling to the power supply coil, wherein the power supply coil is located on an inner side portion relative to the first antenna coil and the second antenna coil when seen in the lamination direction, and at least portions of the first antenna coil and the second antenna coil are located on outer side portions relative to the power supply coil in the lamination direction.

With this configuration, a party-side coil generates magnetic field coupling to the first antenna coil or the second antenna coil in the outer side portion in the lamination direction of the magnetic layers and hardly generates coupling to the power supply coil in the inner side portion in the lamination direction of the magnetic layers. Therefore, when the antenna device communicates with the communication party, formation of a plurality of communication paths is prevented. As a result, a problem that signals having reverse phases flow through different communication paths and are thus cancelled out by each other and communication cannot be made is avoided.

It is preferable that the power supply coil, the first antenna coil, and the second antenna coil be provided over a plurality of layers of the magnetic layers.

With this configuration, coil diameters of the first antenna coil and the second antenna coil are made uniform or substantially uniform. Further, the number of turns of the coils is also able to be increased by increasing the number of the magnetic layers.

It is preferable that a portion of the power supply coil be provided on or in the same layer as at least one of the first antenna coil and the second antenna coil.

With this configuration, the number of the magnetic layers is reduced, thus making it possible to reduce the height of the antenna device.

According to various preferred embodiments of the present invention, a plurality of communication paths are not formed between an antenna device and a communication party, making it possible to avoid a problem that signals having reverse phases flow through the different communication paths and are thus cancelled out by each other and communication cannot be made.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
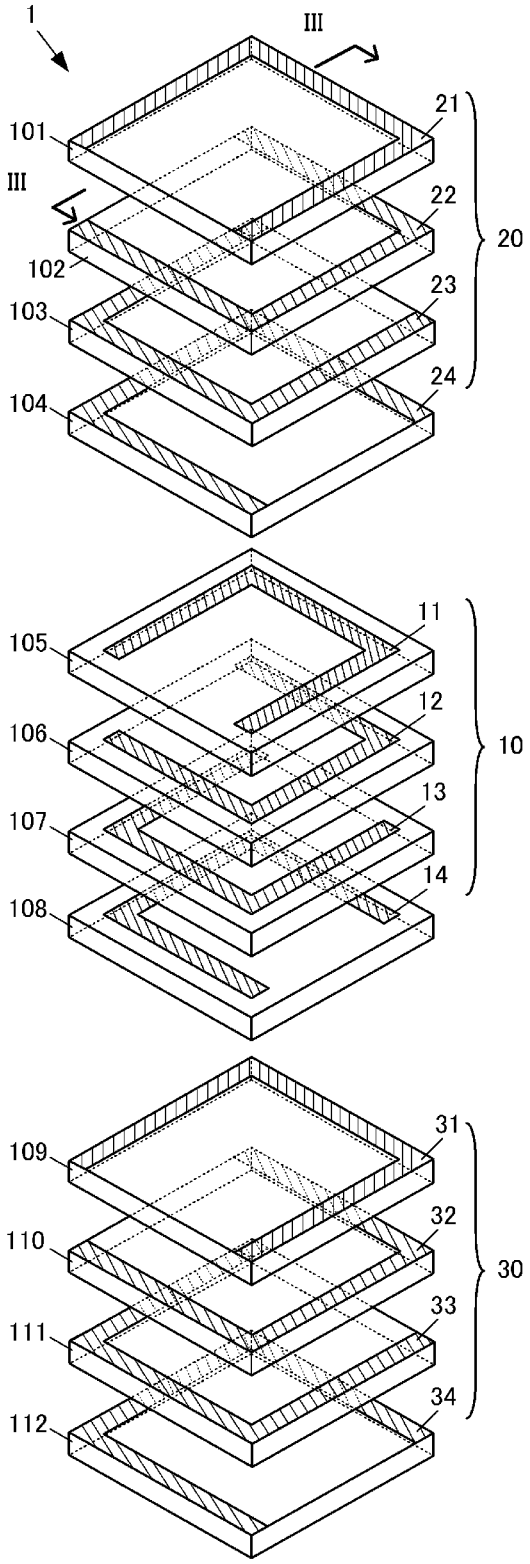
FIG. 1 is an exploded perspective view of an antenna device according to a first preferred embodiment of the present invention.
Figure 2:
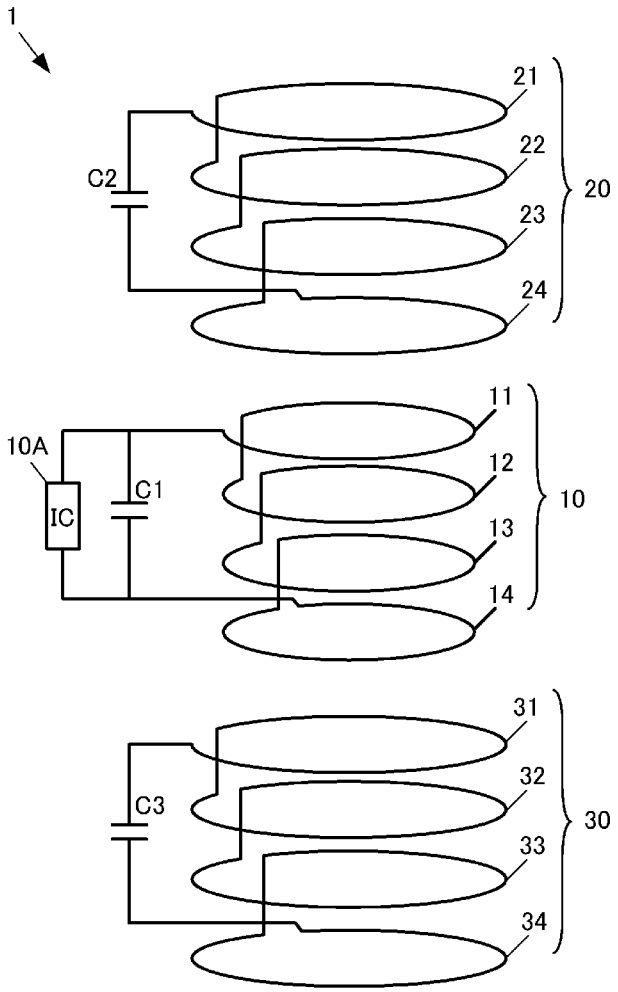
FIG. 2 is a view illustrating connection of wire patterns in the antenna device illustrated in FIG. 1.
Figure 3:
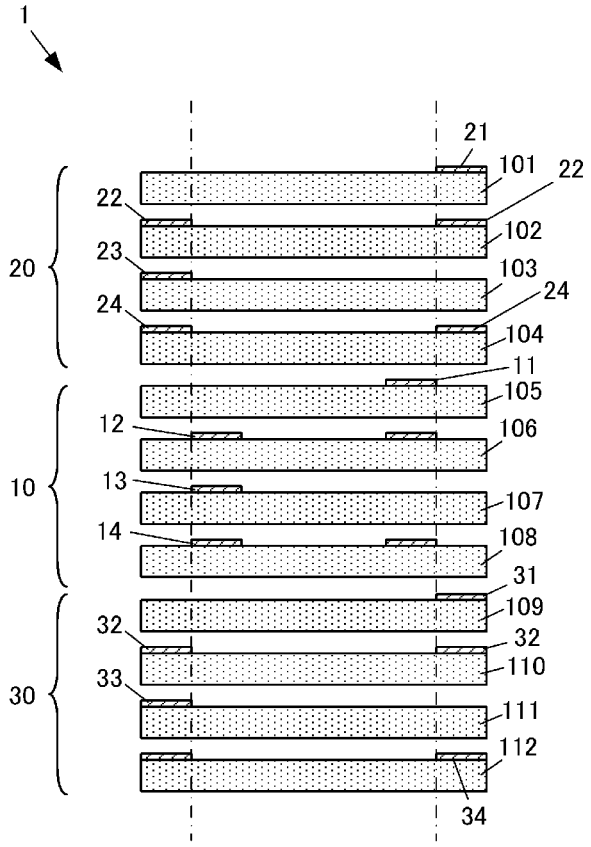
FIG. 3 is a sectional view cut along a line III-III in FIG. 1.
Figure 4:
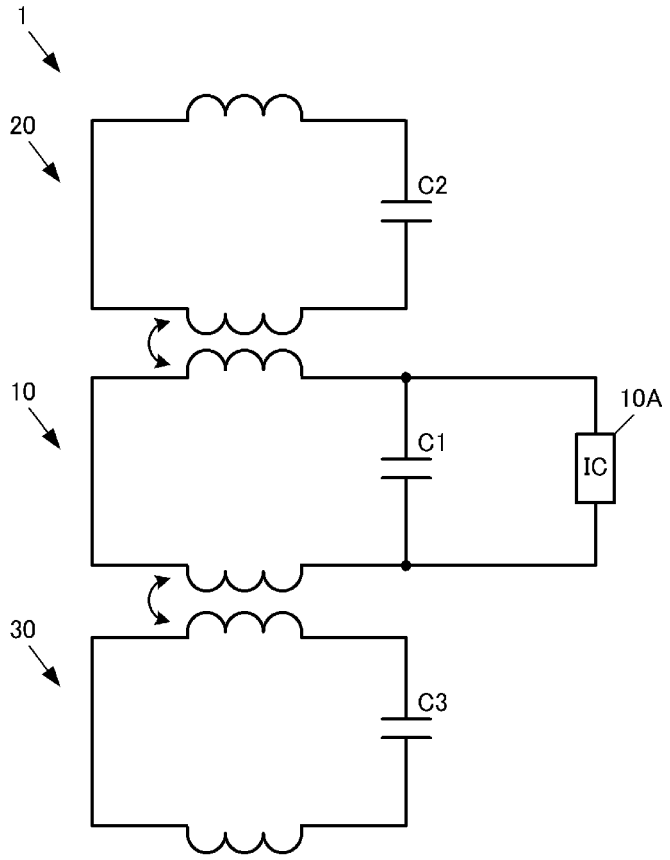
FIG. 4 is a circuit diagram of the antenna device according to the first preferred embodiment of the present invention.

FIG. 1 is an exploded perspective view of an antenna device 1 according to a first preferred embodiment of the present invention. FIG. 2 is a view illustrating connection of wire patterns in the antenna device 1 illustrated in FIG. 1. In FIG. 2, magnetic layers 101 to 112 illustrated in FIG. 1 are omitted. FIG. 3 is a sectional view cut along a line III-III in FIG. 1. FIG. 4 is a circuit diagram of the antenna device 1 according to the first preferred embodiment.

The antenna device 1 according to the first preferred embodiment includes a power supply coil 10 and antenna coils 20 and 30. When the antenna device 1 comes close to a communication party, a coil of the communication party and the antenna coil 20 or the antenna coil 30 generate magnetic field coupling to each other. With this, communication is performed between the antenna device 1 and the communication party.

The power supply coil 10 and the antenna coils 20 and 30 are provided on or in the magnetic layers 101 to 112 with coil winding axes thereof coinciding with the lamination direction. In order to keep the mechanical strength, the magnetic layer 112 defining an outermost layer may be a non-magnetic layer, and a non-magnetic layer (not illustrated) may be provided on an outer side of the magnetic layer 101. Further, a non-magnetic layer may also be provided on an intermediate layer of the magnetic layers 101 to 112 in the same manner. The power supply coil 10 is provided on or in the magnetic layers 105 to 108 in a center portion or substantially a center portion of the magnetic layers 101 to 112 in the lamination direction. The antenna coils 20 and 30 are provided, respectively, on or in the magnetic layers 101 to 104 and 109 to 112 on outer side portions of the magnetic layer 105 to 108 in the lamination direction. That is to say, the power supply coil 10 is interposed between the antenna coils 20 and 30 in the lamination direction of the magnetic layers 101 to 112. In the present preferred embodiment, the power supply coil 10 and the antenna coils 20 and 30 are arranged such that the coil winding axes thereof extend along the same straight line.

The power supply coil 10 includes wire patterns 11 to 14 provided on surfaces of the magnetic layers 105 to 108, respectively. The wire patterns 11 to 14 are connected to the wire patterns on the upper and lower layers with via holes (not illustrated in FIG. 1), and the wire patterns 11 to 14 and the via holes define the coil. Further, as illustrated in FIG. 2, the wire patterns 11 and 14 are connected with each other with a capacitor C1 interposed therebetween. The capacitor C1 defines a resonance circuit together with the coil defined by the wire patterns 11 to 14. An IC 10A that transmits and receives a signal to and from the resonance circuit is connected to the resonance circuit. For example, when the antenna device 1 is the transmission side, the IC 10A transmits a signal to the resonance circuit, whereas when the antenna device 1 is the reception side, the IC 10A receives a signal from the resonance circuit.

The antenna coils 20 and 30 include, respectively, wire patterns 21 to 24 and 31 to 34 provided on surfaces of the magnetic layers 101 to 104 and 109 to 112. The wire patterns 21 to 24 and 31 to 34 are connected to the wire patterns on the upper and lower layers with via holes, and the wire patterns 21 to 24 and 31 to 34 and the via holes define the coils. As illustrated in FIG. 2, the wire patterns 21 and 24 are connected with each other with a capacitor C2 interposed therebetween, and the wire patterns 31 and 34 are connected with each other with a capacitor C3 interposed therebetween. As illustrated in FIG. 4, the capacitor C2 defines a resonance circuit together with the coil defined by the wire patterns 21 to 24, and the capacitor C3 defines a resonance circuit together with the coil defined by the wire patterns 31 to 34.

In FIG. 1 to FIG. 3, the wire patterns 11 to 14, 21 to 24, and 31 to 34 are structured such that winding directions thereof are the same. However, the winding direction may be different among the power supply coil and the antenna coils. Even when the winding directions are different, the intensity of the magnetic field coupling is hardly influenced. The directions of the coil winding axes of the power supply coil 10 and the antenna coils 20 and 30 are set to the lamination direction of the magnetic layers 101 to 112. Therefore, the power supply coil 10 and the antenna coil 20 generate magnetic field coupling to each other, and the power supply coil 10 and the antenna coil 30 generate magnetic field coupling to each other.

As illustrated in FIG. 3, the wire patterns 11 to 14 in the power supply coil 10 preferably have a coil diameter smaller than those of the wire patterns 21 to 24 and 31 to 34 in the antenna coils 20 and 30. To be more specific, the wire patterns 21 to 24 and 31 to 34 in the antenna coils 20 and 30 preferably have the same coil diameter and extend along end portions on the surfaces of the magnetic layers 101 to 104 and 109 to 112, respectively. The wire patterns 11 to 14 in the power supply coil 10 do not overlap with the wire patterns 21 to 24 and 31 to 34 in the lamination direction. In other words, when seen in the lamination direction of the magnetic layers, the wire patterns 11 to 14 are located at an inner side portion relative to the wire patterns 21 to 24 and 31 to 34. As a result, in the antenna coils 20 and 30, not all loops of magnetic fluxes are confined in a magnetic body, thus making it possible to make magnetic field radiation larger. Closed loops are not present in the antenna coils 20 and 30, thus making it possible to make the magnetic field radiation larger. The wire patterns 21 and 34 in the antenna coils 20 and 30, which are provided on outer side portions in the antenna device 1, may be large, and the wire patterns may be made smaller toward inner layers of the magnetic body. However also in this case, it should be noted that, when the antenna device 1 is seen from the above in the winding axis direction, an outer periphery of the power supply coil 10 is located inward relative to outer peripheries of the antenna coils 20 and 30.

When the party-side coil (coil of the communication party) is brought close to the antenna device 1, the party-side coil generates magnetic field coupling to one of the antenna coils 20 and 30 in the outer side portions in the lamination direction of the magnetic layers. With this, as the communication path from the antenna device 1 to the communication party, a communication path of the power supply coil→the resonance coil→the party-side coil is provided. In this case, the power supply coil 10 has a coil diameter smaller than those of the antenna coils 20 and 30 and is spaced apart from the outermost layers of the magnetic layers. Therefore, the party-side coil hardly generates magnetic field coupling to the power supply coil 10. Accordingly, as the communication path from the antenna device 1 to the communication party, a communication path of the power supply coil→the party-side coil is not provided.

In the case where two communication paths are provided between the antenna device 1 and the communication party, when signals passing through the communication paths have reverse phases, the signals are cancelled out by each other and the communication party cannot receive the signals from the antenna device 1. In the present preferred embodiment, as described above, a plurality of communication paths are not formed or provided between the antenna device 1 and the communication party. Therefore, the communication party is able to receive the signal from the antenna device 1 reliably, and communication is performed between the antenna device 1 and the communication party reliably.

Hereinafter, another example of the antenna device 1 according to the first preferred embodiment will be described.

Figure 5:
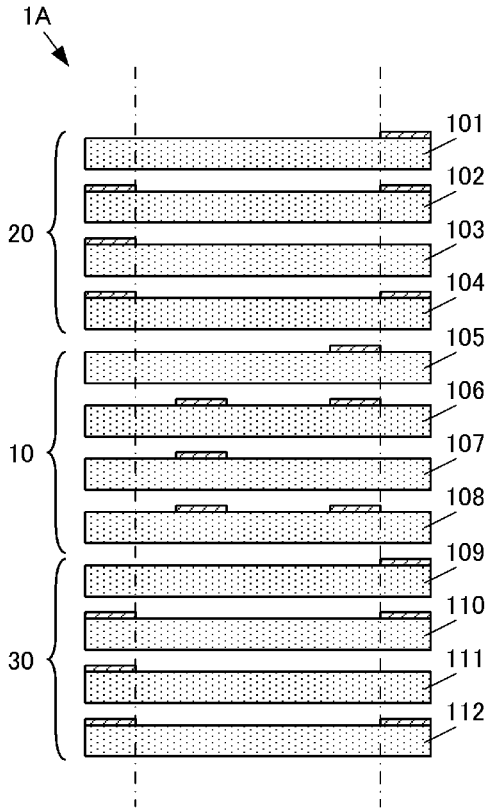
FIG. 5 is a view illustrating a variation of an antenna device according to a preferred embodiment of the present invention.
Figure 6:
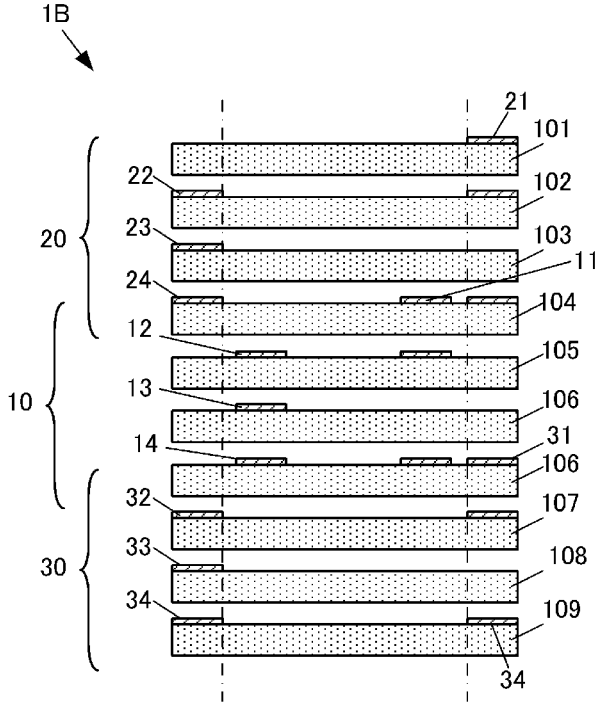
FIG. 6 is a view illustrating another variation of an antenna device according to a preferred embodiment of the present invention.
Figure 7:
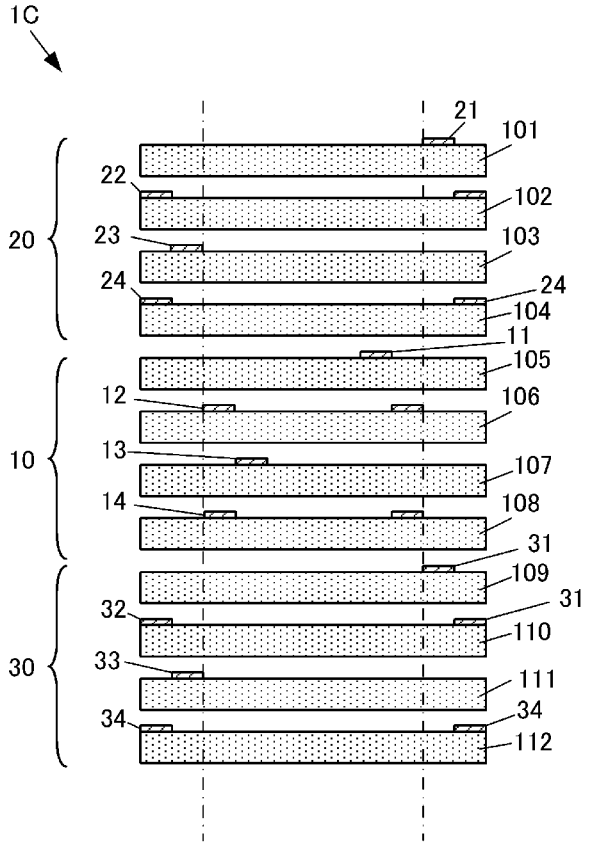
FIG. 7 is a view illustrating still another variation of an antenna device according to a preferred embodiment of the present invention.

FIG. 5, FIG. 6, and FIG. 7 illustrate variations of an antenna device of a preferred embodiment of the present invention. FIG. 5, FIG. 6, and FIG. 7 correspond to sectional views cut along the line III-III illustrated in FIG. 1.

An antenna device 1A illustrated in FIG. 5 has a configuration in which a coil winding axis of the power supply coil 10 does not coincide with coil winding axes of the antenna coils 20 or 30. In this case, intensities of the magnetic field couplings between the power supply coil 10 and the antenna coils 20 and 30 are able to be changed without changing the total thickness or the coil diameter of the antenna device 1A.

An antenna device 1B illustrated in FIG. 6 has a configuration in which the wire pattern 11 of the power supply coil 10 is provided on the magnetic layer 104 on which the wire pattern 24 of the antenna coil 20 is provided, and the wire pattern 14 of the power supply coil 10 is provided on the magnetic layer 106 on which the wire pattern 31 of the antenna coil 30 is provided. That is to say, the power supply coil 10 and the antenna coil 20 share one magnetic layer, and the power supply coil 10 and the antenna coil 30 share one magnetic layer. In this case, the antenna device 1B allows the number of magnetic layers to be reduced, thus making it possible to reduce the height of the antenna device 1B.

An antenna device 1C illustrated in FIG. 7 has a configuration in which respective diameters of the wire patterns in each of the power supply coil 10 and the antenna coils 20 and 30 are different. For example, in the case of the antenna coil 20, the wire patterns 21 and 22 have different coil diameters. In this example, the wire patterns on layers that are vertically close to each other do not oppose each other. Therefore, capacitances between the wire patterns are reduced.

With any of the configurations illustrated in FIG. 5 to FIG. 7, it is sufficient that the power supply coil 10 is located on the inner side portion relative to the antenna coils 20 and 30 when seen in the lamination direction of the magnetic layers and portions of the antenna coils 20 and 30 are provided on the outer side portions relative to the power supply coil 10 in the lamination direction.

Figure 8:
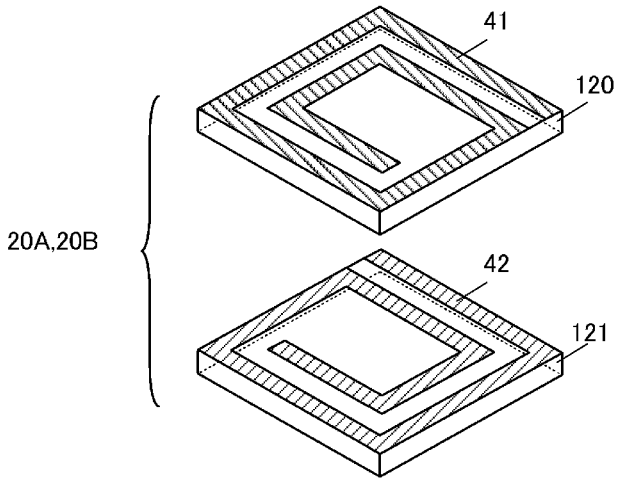
FIG. 8 is an exploded perspective view of another example of an antenna coil having a configuration different from the configuration illustrated in FIG. 1.
Figure 9:
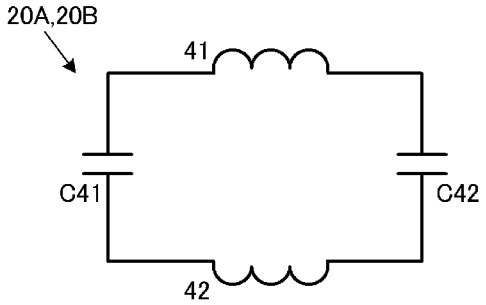
FIG. 9 is a circuit diagram of the antenna coil illustrated in FIG. 8.

FIG. 8 is an exploded perspective view of another example of the antenna coil 20 (or 30) having a configuration different from the configuration illustrated in FIG. 1. FIG. 9 is a circuit diagram of antenna coil 20A or 20B illustrated in FIG. 8.

In the antenna coil 20 illustrated in FIG. 1, the wire patterns extend over a plurality of magnetic layers and the wire patterns on the outermost layers are connected with each other with a capacitor interposed therebetween. In contrast, in the antenna coils 20A and 20B illustrated in FIG. 8, wire patterns 41 and 42 are wound on magnetic layers 120 and 121, respectively, in the same winding direction such that the wire patterns oppose each other. In this case, capacitors C41 and C42 are located between the opposing wire patterns 41 and 42, as illustrated in FIG. 9. With this, a resonance circuit is provided. This case does not require an actual component of the capacitor, thus making it possible to reduce the number of components. Further, in comparison with the antenna coil 20 illustrated in FIG. 1, the number of magnetic layers that define the antenna coil 20A or 20B is reduced, thus making it possible to reduce the height of the antenna device.

Figure 10:
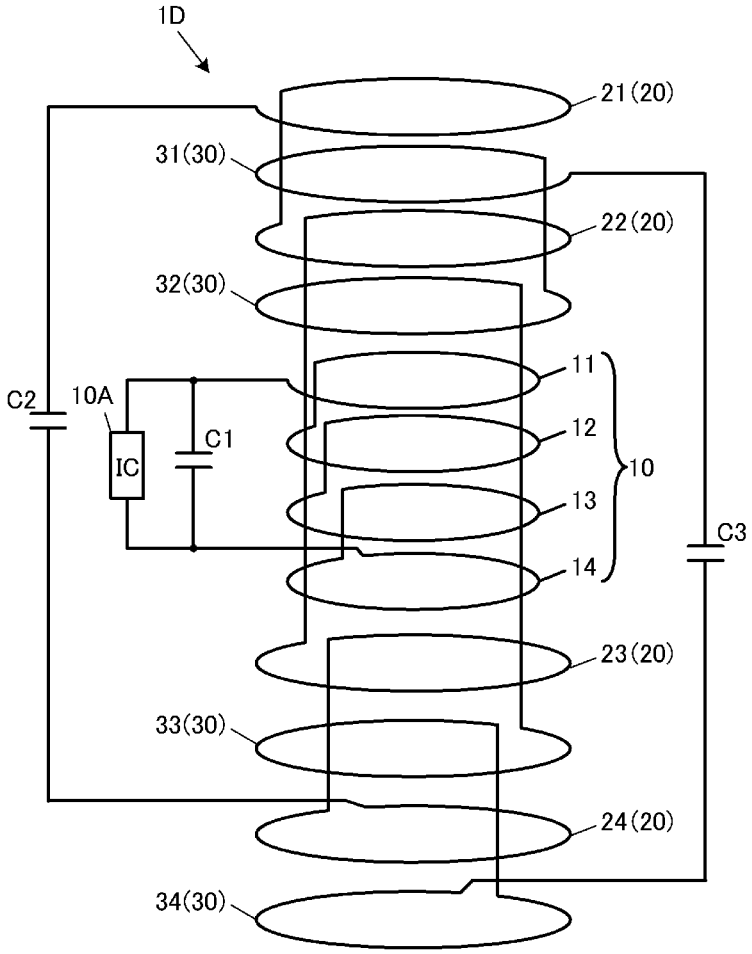
FIG. 10 is a view illustrating an example of connection of wire patterns in an antenna device in which wire patterns of two antenna coils are alternately provided.

FIG. 10 is a view illustrating an example of connection of wire patterns in an antenna device 1D in which the wire patterns of the two antenna coils 20 and 30 are alternately provided. The wire patterns in the respective antenna coils 20 and 30 illustrated in FIG. 1 are wound independently from each other. On the other hand, in the antenna device 1D illustrated in FIG. 10, the wire patterns 21 and 22 in the antenna coil 20 and the wire patterns 31 and 32 in the antenna coil 30 are alternately provided, and the wire patterns 23 and 24 in the antenna coil 20 and the wire patterns 33 and 34 in the antenna coil 30 are alternately provided. In this case, an inter-layer distance between the antenna coils 20 and 30 is made smaller, so that coupling between the antenna coil 20 and the antenna coil 30 is intensified. With this, a configuration is provided in which the power supply coil and the antenna coils 20 and 30 have a plurality of resonant frequencies. Therefore, the antenna device 1D is able to be used in a broad frequency band.

Figure 11:
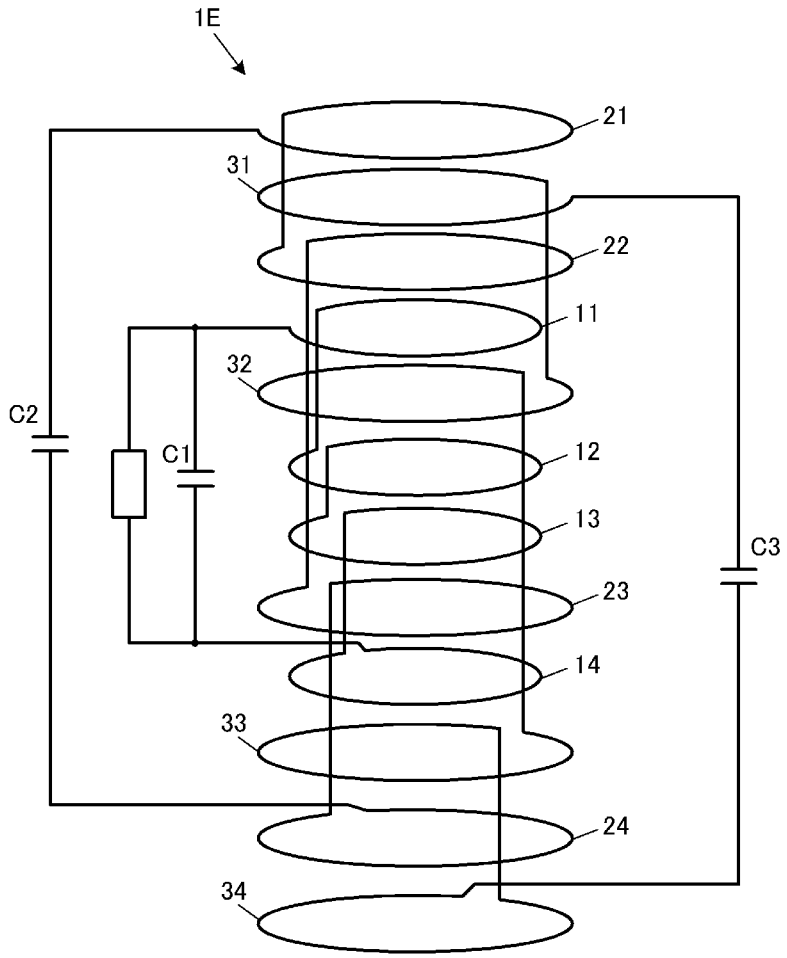
FIG. 11 is a view illustrating an example of connection of wire patterns in an antenna device in which wire patterns of a power supply coil and two antenna coils are alternately provided.

FIG. 11 is a view illustrating an example of connection of wire patterns in an antenna device 1E in which wire patterns in the power supply coil 10 and the two antenna coils 20 and 30 are alternately provided. The antenna device 1E has a configuration in which the wire pattern 11 in the power supply coil 10 is located between the wire patterns 22 and 32 and the wire pattern 14 is located between the wire patterns 23 and 33 in addition to the configuration of the antenna coils 20 and 30 illustrated in FIG. 10. In this case, coupling among the antenna coils 20 and 30 and the power supply coil 10 is further intensified than in the antenna device 1D in FIG. 10.

Figure 12:
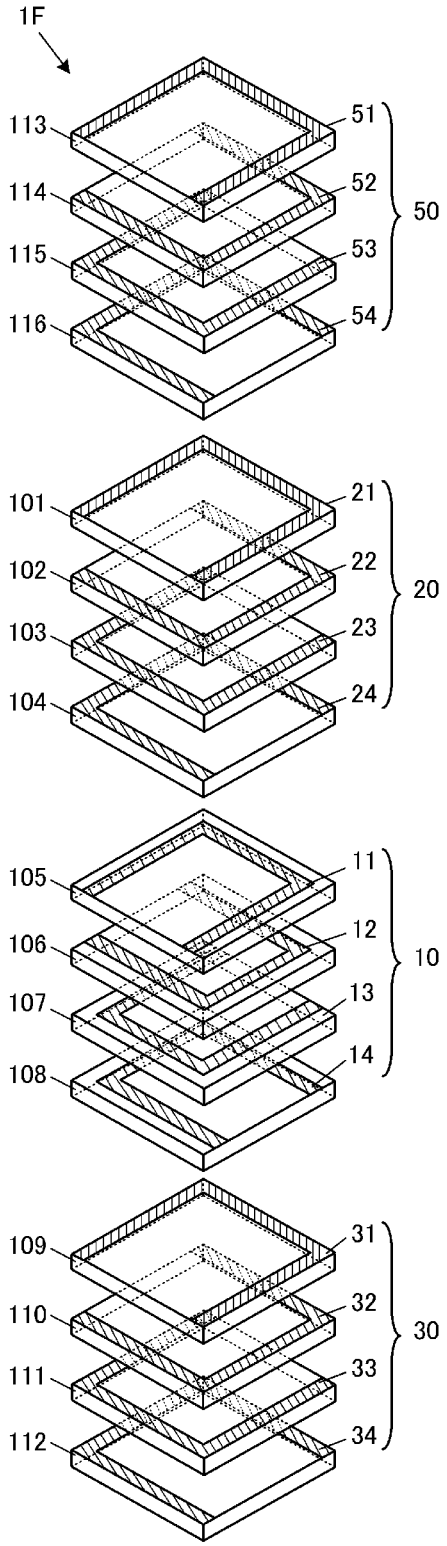
FIG. 12 is an exploded perspective view of an antenna device including three antenna coils.

FIG. 12 is an exploded perspective view of an antenna device 1F including three antenna coils. The antenna device 1F in this example includes magnetic layers 113 to 116 that are further laminated on the magnetic layer 101 in addition to the configuration of the antenna device 1 illustrated in FIG. 1. Wire patterns 51 to 54 are provided on the magnetic layers 113 to 116, respectively, so as to define an antenna coil 50. Although not illustrated in the drawing, as in the antenna coils 20 and 30, the wire patterns 51 and 54 are connected with each other with a resonance capacitor interposed therebetween.

As illustrated in FIG. 12, as the antenna coils are stacked, the directivity is able to be set to the lamination direction. Further, resonance is obtained at a plurality of proximate frequencies, thus making it possible to broaden the band of the antenna device 1F.

Second Preferred Embodiment

Hereinafter, a second preferred embodiment of an antenna device according to the present invention will be described. In the second preferred embodiment, a communication apparatus including the antenna device 1 according to the first preferred embodiment will be described. The communication apparatus according to the present preferred embodiment is, for example, a cellular phone, a personal digital assistant (PDA), a portable music player, or the like, and functions as a reader/writer device that reads information from an IC tag.

Figure 13:
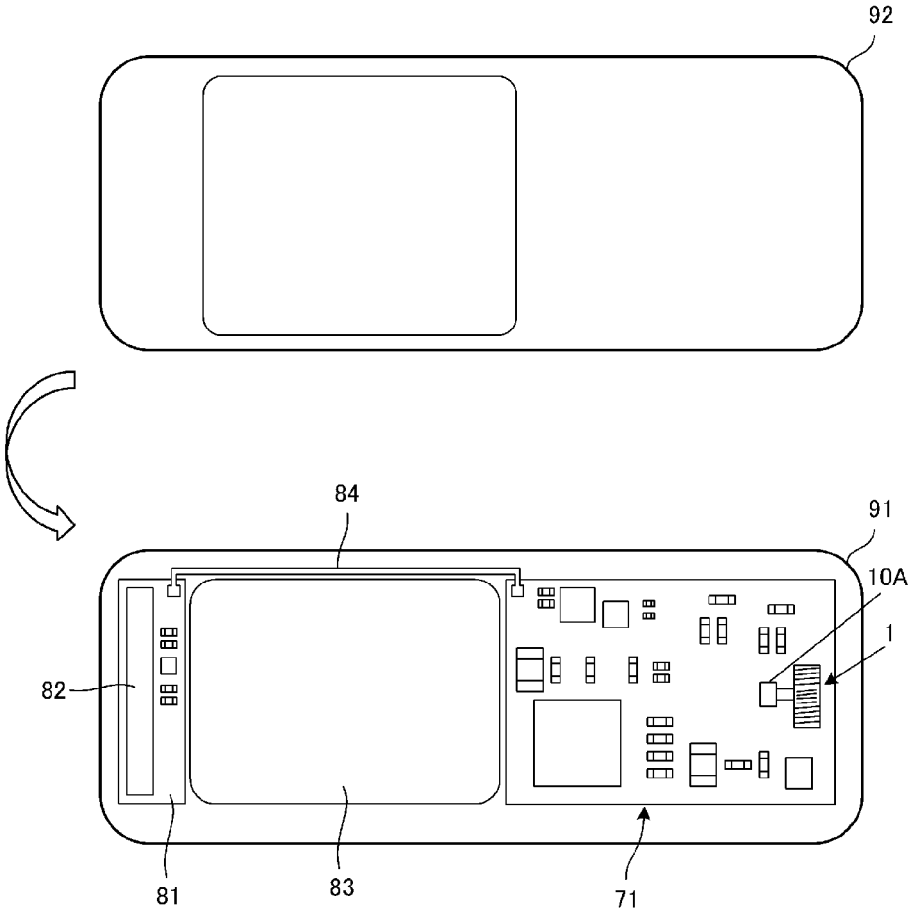
FIG. 13 is a view illustrating a configuration of an inner portion of a housing of a wireless communication apparatus including an antenna device according to a preferred embodiment of the present invention.
Figure 14:
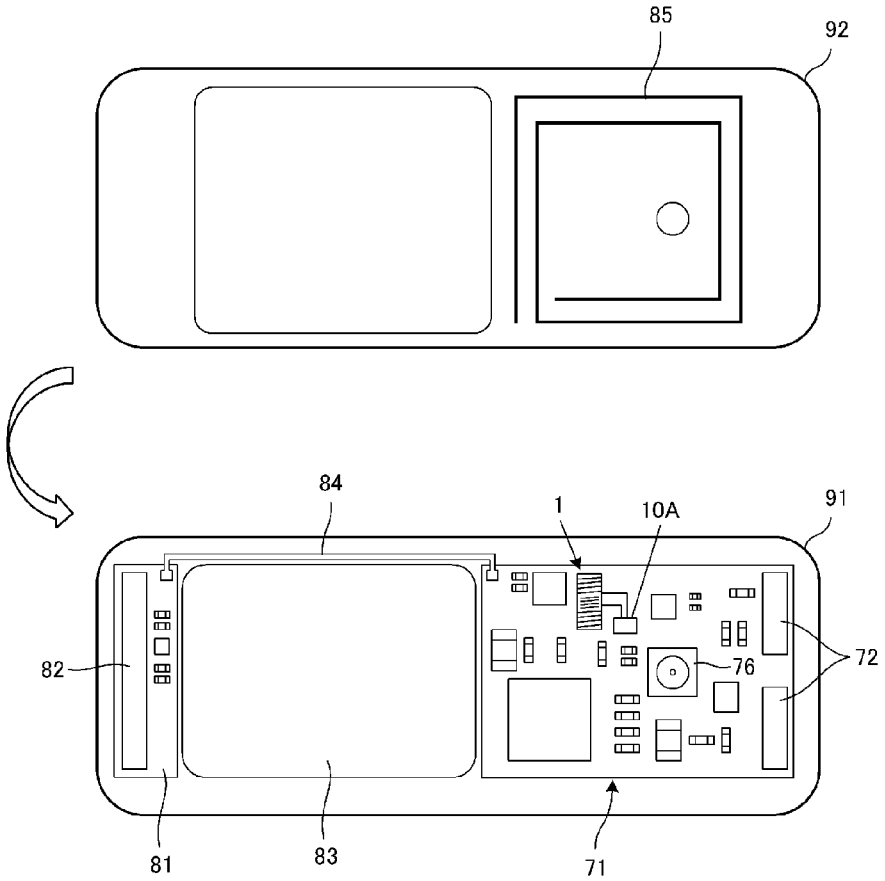
FIG. 14 is a view illustrating a configuration of an inner portion of a housing of a wireless communication apparatus including an antenna device according to a preferred embodiment of the present invention.

FIG. 13 and FIG. 14 are views illustrating an inner portion of a housing of a wireless communication apparatus including the antenna device and are plan views in a state where an upper housing 91 and a lower housing 92 are separated and the inner portion thereof is exposed.

In an example of FIG. 13, circuit substrates 71 and 81, a battery pack 83, and so on are accommodated in the housing 91. The antenna device 1 and so on are mounted on the circuit substrate 71. A UHF-band antenna 82 and so on are mounted on the circuit substrate 81. The circuit substrate 71 and the circuit substrate 81 are connected with each other with a cable 84 interposed therebetween.

In an example of FIG. 14, UHF band antennas 72, a camera module 76, and so on are also mounted on the circuit substrate 71. Further, a booster coil antenna 85 is provided in the lower housing 92. The booster coil antenna 85 generates magnetic field coupling to both of the coil antennas 20 and 30 of the antenna device 1. The booster coil antenna 85 generates magnetic field coupling to a party-side coil, so that communication is made between the communication apparatus and the communication party.

The communication apparatus configured as described above performs communication with an IC tag defining and functioning as the communication party reliably while an unnecessary communication path is not formed, as in the first preferred embodiment.

In the second preferred embodiment, the communication apparatus including the antenna device 1 according to the first preferred embodiment has been described. However, a preferred embodiment may be applied to a tag including the antenna device 1 according to the first preferred embodiment. When the tag is used, communication is performed between the tag and the reader/writer device by bringing the tag close to the reader/writer device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

magnetic layers;

a power supply coil provided on or in the magnetic layers with a winding axis coinciding with a lamination direction of the magnetic layers; and a first antenna coil and a second antenna coil that are provided on or in the magnetic layers with winding axes coinciding with the lamination direction of the magnetic layers and that generate magnetic field coupling to the power supply coil; wherein the power supply coil is located on an inner portion relative to the first antenna coil and the second antenna coil when seen in the lamination direction; and at least portions of the first antenna coil and the second antenna coil are located on outer portions relative to the power supply coil in the lamination direction.

2. The antenna device according to claim 1, wherein the power supply coil, the first antenna coil, and the second antenna coil are provided over a plurality of layers of the magnetic layers.

3. The antenna device according to claim 1, wherein a portion of the power supply coil is provided on or in a same layer of the magnetic layers as at least one of the first antenna coil and the second antenna coil.

4. The antenna device according to claim 1, wherein outermost layers of the antenna device are defined by non-magnetic layers disposed on the magnetic layers.

5. The antenna device according to claim 1, wherein an outermost layer is disposed to define an intermediate layer between the magnetic layers.

6. The antenna device according to claim 1, wherein the winding axes of the power supply coil and the first and second antenna coils extend along a same straight line.

7. The antenna device according to claim 1, wherein the power supply coil includes wire patterns provided on surfaces of the magnetic layers and two of the wire patterns are connected with each other with a capacitor interposed therebetween.

8. The antenna device according to claim 7, wherein the capacitor defines a resonance circuit with the power supply coil.

9. The antenna device according to claim 1, wherein the first antenna coil and the second antenna coil include wire patterns provided on surfaces of the magnetic layers and two of the wire patterns of the first antenna coil are connected with each other with a first capacitor interposed therebetween and two of the wire patterns of the second antenna coil are connected with each other with a second capacitor interposed therebetween.

10. The antenna device according to claim 9, wherein the first capacitor defines a resonance circuit with the first antenna coil and the second capacitor defines a resonance circuit with the second antenna coil.

11. The antenna device according to claim 1, wherein the power supply coil, the first antenna coil, and the second antenna coil include wire patterns that have a same winding direction.

12. The antenna device according to claim 1, wherein the power supply coil, the first antenna coil, and the second antenna coil include wire patterns that have a different winding direction.

13. The antenna device according to claim 1, wherein the power supply coil, the first antenna coil, and the second antenna coil include wire patterns and the wire patterns of the power supply coil have a coil diameter smaller than those of the wire patterns of the first and second antenna coils.

14. The antenna device according to claim 13, wherein the wire patterns of the first and second antenna coils have a same diameter.

15. The antenna device according to claim 1, wherein the power supply coil, the first antenna coil, and the second antenna coil include wire patterns, and the wire patterns of the power supply coil do not overlap the wire patterns of the first and second antenna coils.

16. The antenna device according to claim 1, wherein the winding axis of the power supply coil does not coincide with winding axes of the first and second antenna coils.

17. The antenna device according to claim 1, wherein the power supply coil, the first antenna coil, and the second antenna coil include wire patterns, and one of the wire patterns of the power supply coil is provided on a same one of the magnetic layers on which one of the wire patterns of the first antenna coil is provided, and another one of the wire patterns of the power supply coil is provided on a same one of the magnetic layers on which one of the wire patterns of the second antenna coil is provided.

18. The antenna device according to claim 1, wherein the power supply coil, the first antenna coil, and the second antenna coil include wire patterns, and two of the wire patterns are provided on two different ones of the magnetic layers in a same winding direction such that the two of the wire patterns oppose each other.

19. The antenna device according to claim 18, wherein two capacitors are located between the two of the wire patterns opposing each other to define a resonance circuit.

20. A communication apparatus comprising:

the antenna device according to claim 1.

* * * * *